US010457996B2

(12) United States Patent
Hill et al.

(10) Patent No.: US 10,457,996 B2
(45) Date of Patent: Oct. 29, 2019

(54) NANOCRYSTALLINE BAINITIC STEELS, SHAFTS, GAS TURBINE ENGINES, AND METHODS OF MANUFACTURING NANOCRYSTALLINE BAINITIC STEELS

(71) Applicant: ROLLS-ROYCE plc, London (GB)

(72) Inventors: Paul O Hill, Derby (GB); Steve W Ooi, Cambridge (GB); Christopher N Hulme-Smith, Cambridge (GB); Harshad K Bhadeshia, Cambridge (GB); Martin J Rawson, Derby (GB); Mathew J Peet, Cambridge (GB)

(73) Assignee: ROLLS-ROYCE plc, London (GB)

( * ) Notice: Subject to any disclaimer, the term of this patent is extended or adjusted under 35 U.S.C. 154(b) by 332 days.

(21) Appl. No.: 15/440,797

(22) Filed: Feb. 23, 2017

(65) Prior Publication Data

US 2017/0275716 A1 Sep. 28, 2017

(30) Foreign Application Priority Data

Mar. 23, 2016 (GB) ..... 1604910.8

(51) Int. Cl.
*C21D 6/00* (2006.01)
*C22C 38/10* (2006.01)
(Continued)

(52) U.S. Cl.
CPC ..... *C21D 6/001* (2013.01); *C21D 1/18* (2013.01); *C21D 6/005* (2013.01); *C21D 6/02* (2013.01);
(Continued)

(58) Field of Classification Search
CPC ..... C21D 6/001; C21D 6/005; C21D 6/007; C21D 1/18; C21D 2211/002; C22C 2200/04; C22C 38/04; C22C 38/06; C22C 38/105; C22C 38/12; C22C 38/44; C22C 38/52; F01D 25/005; F01D 5/02; F01D 5/28; F01D 5/286; F05D 2220/32; F05D 2240/60; F05D 2300/171; F05D 2300/605
See application file for complete search history.

(56) References Cited

U.S. PATENT DOCUMENTS 4,933,008 A 6/1990 Fujiki et al.
5,360,318 A * 11/1994 Siga ..... C22C 38/44 415/216.1
(Continued)

FOREIGN PATENT DOCUMENTS

EP 2 439 288 A1 4/2012
GB 1 023 132 A 3/1966
(Continued)

OTHER PUBLICATIONS

Jan. 2, 2018 Extended Search Report issued in European Patent Application No. 17157656.4.
(Continued)

*Primary Examiner* — Ngoc-Yen Nguyen
(74) *Attorney, Agent, or Firm* — Oliff PLC

(57) ABSTRACT

A nanocrystalline bainitic steel consisting of, by weight percentage: 0.3% to 0.6% carbon; 9.0% to 20.0% nickel; up to 10% cobalt; 1.0% to 4.5% aluminium; up to 0.5% molybdenum; up to 0.5% manganese; up to 0.5% tungsten; up to 3.0% chromium; and the balance being iron and impurities.

7 Claims, 3 Drawing Sheets

(51) Int. Cl.

| | |
|---|---|
| ***C22C 38/04*** | (2006.01) |
| ***C22C 38/12*** | (2006.01) |
| ***C22C 38/06*** | (2006.01) |
| ***C21D 1/18*** | (2006.01) |
| ***F01D 25/00*** | (2006.01) |
| ***C22C 38/44*** | (2006.01) |
| ***C22C 38/52*** | (2006.01) |
| ***F01D 5/02*** | (2006.01) |
| ***F01D 5/28*** | (2006.01) |
| ***C21D 6/02*** | (2006.01) |
| ***C21D 9/00*** | (2006.01) |
| *C21D 7/13* | (2006.01) |

(52) U.S. Cl.

CPC ..... *C21D 9/0068* (2013.01); *C22C 38/04* (2013.01); *C22C 38/06* (2013.01); *C22C 38/105* (2013.01); *C22C 38/12* (2013.01); *C22C 38/44* (2013.01); *C22C 38/52* (2013.01); *F01D 5/02* (2013.01); *F01D 5/28* (2013.01); *F01D 5/286* (2013.01); *F01D 25/005* (2013.01); *C21D 6/007* (2013.01); *C21D 7/13* (2013.01); *C21D 2211/002* (2013.01); *C21D 2211/004* (2013.01); *C22C 2200/04* (2013.01); *F05D 2220/32* (2013.01); *F05D 2240/60* (2013.01); *F05D 2300/171* (2013.01); *F05D 2300/605* (2013.01)

(56) References Cited

U.S. PATENT DOCUMENTS

| | | | | |
|---|---|---|---|---|
| 2005/0274222 | A1 | 12/2005 | Hwang et al. | |
| 2010/0247368 | A1 | 9/2010 | Rawson et al. | |
| 2014/0271144 | A1* | 9/2014 | Landwehr ..... | F01D 11/08 415/173.1 |
| 2015/0118098 | A1* | 4/2015 | Valls ..... | C21D 9/00 420/102 |

FOREIGN PATENT DOCUMENTS

| | | | |
|---|---|---|---|
| GB | 1023123 | A | 3/1966 |
| GB | 1 089 934 | A | 11/1967 |
| GB | 1 089 935 | A | 11/1967 |
| GB | 1090647 | A | 11/1967 |
| GB | 2 352 726 | A | 2/2001 |
| JP | S563561 | A | 1/1981 |
| JP | S5867850 | A | 4/1983 |
| JP | S63114942 | A | 5/1988 |
| JP | H02294450 | A | 12/1990 |
| JP | H0375333 | A | 3/1991 |
| JP | 2004035992 | A | 2/2004 |

OTHER PUBLICATIONS

Nov. 14, 2016 Search Report issued in Great Britain Patent Application No. 1604910.8.

Hulme-Smith et al; "Enhanced Thermal Stability in Nanostructured Bainitic Steel;" Elsevier Science; Jan. 7, 2015; pp. 1-9.

* cited by examiner

NANOCRYSTALLINE BAINITIC STEELS, SHAFTS, GAS TURBINE ENGINES, AND METHODS OF MANUFACTURING NANOCRYSTALLINE BAINITIC STEELS

TECHNOLOGICAL FIELD

The present disclosure concerns nanocrystalline bainitic steels, shafts, gas turbine engines, and methods of manufacturing nanocrystalline bainitic steels.

BACKGROUND

Gas turbine engines typically include a turbine module that is arranged to drive a compressor module via one or more interconnecting shafts. For example, in a 'three-shaft' gas turbine engine, a propulsive fan is driven by a low pressure turbine via the low pressure shaft. The low pressure shaft comprises two shafts, specifically, a low pressure turbine shaft and a low pressure compressor shaft which are made of different materials. The low pressure turbine shaft and the low pressure compressor shaft are joined coaxially and end to end by a helical spline joint.

The spline region of the low pressure turbine shaft operates at a relatively low temperature (approximately 150 Celsius), but may require a challenging combination of mechanical properties, for example, high torque carrying capability, high ultimate tensile strength, high 0.2% proof stress, and good fatigue strength. Consequently, the spline region of the low pressure turbine shaft is usually made from an alloy such as AerMet® 100. However, this alloy is not suitable for use at elevated temperatures (for example, above 400 Celsius) for extended periods of time because of over-aging of the carbide structures, which may significantly reduce the yield and tensile strengths and has an adverse effect on the creep resistance.

The rear part of the low pressure turbine shaft is not subject to the torque loads experienced by the spline, but may reach temperatures of up to 450 Celsius for extended periods. The rear part of the low pressure turbine shaft is therefore usually made from an alloy such as Super-CMV which is welded to the spline region of the low pressure turbine shaft. This alloy does not have the torque carrying capability or the fatigue strength to be used in the low temperature spline region of the shaft, but the microstructure is relatively stable up to 450 Celsius giving the alloy good thermal stability and creep capability.

It should be appreciated from the preceding paragraphs that the manufacture of the low pressure turbine shaft is relatively complex as it is fabricated from sections made from two different materials. Furthermore, the presence of a welded joint increases cost and manufacturing time.

BRIEF SUMMARY

According to various examples there is provided a nanocrystalline bainitic steel consisting of, by weight percentage: 0.3% to 0.6% carbon; 9.0% to 20.0% nickel; up to 10% cobalt; 1.0% to 4.5% aluminium; up to 0.5% molybdenum; up to 0.5% manganese; up to 0.5% tungsten; up to 3.0% chromium; and the balance being iron and impurities.

The nanocrystalline bainitic steel may consist of, by weight percentage: 0.35% to 0.45% carbon; 11.0% to 15.0% nickel; 2.0% to 6.0% cobalt; 2.0% to 3.0% aluminium; 0.2% to 0.4% molybdenum; 0.05% to 0.25% manganese; up to 0.5% tungsten; up to 3% chromium; and the balance being iron and impurities.

The nanocrystalline bainitic steel may consist of, by weight percentage: 0.4% carbon; 13.0% nickel; 4.0% cobalt; 2.5% aluminium; 0.3% molybdenum; 0.15% manganese; and the balance being iron and impurities.

The nanocrystalline bainitic steel may comprise a plurality of nickel aluminide intermetallic particles.

According to various examples there is provided a shaft comprising the nanocrystalline bainitic steel as described in any of the preceding paragraphs.

The shaft may be a low pressure shaft and may include a low pressure compressor shaft and a low pressure turbine shaft. The low pressure turbine shaft may have a first end, a second opposite end, and a longitudinal axis extending between the first end and the second end. The low pressure turbine shaft may have no joint between the first end and the second end.

According to various examples there is provided a gas turbine engine comprising a shaft as described in any of the preceding paragraphs.

The low pressure shaft may extend between a low pressure turbine and a low pressure compressor, or a fan, or a gearbox.

According to various examples there is provided an object comprising the nanocrystalline bainitic steel as described in any of the preceding paragraphs.

According to various examples there is provided a method of manufacturing a nanocrystalline bainitic steel as described in any of the preceding paragraphs.

The method may comprise maintaining a transformation temperature of the steel between 150 Celsius and 350 Celsius.

The method may further comprise tempering the steel to form a plurality of nickel aluminide intermetallic particles.

Tempering the steel may be performed at a temperature between 250 Celsius and 500 Celsius.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION

Embodiments will now be described by way of example only, with reference to the Figures, in which.

DETAILED DESCRIPTION

Figure 1:
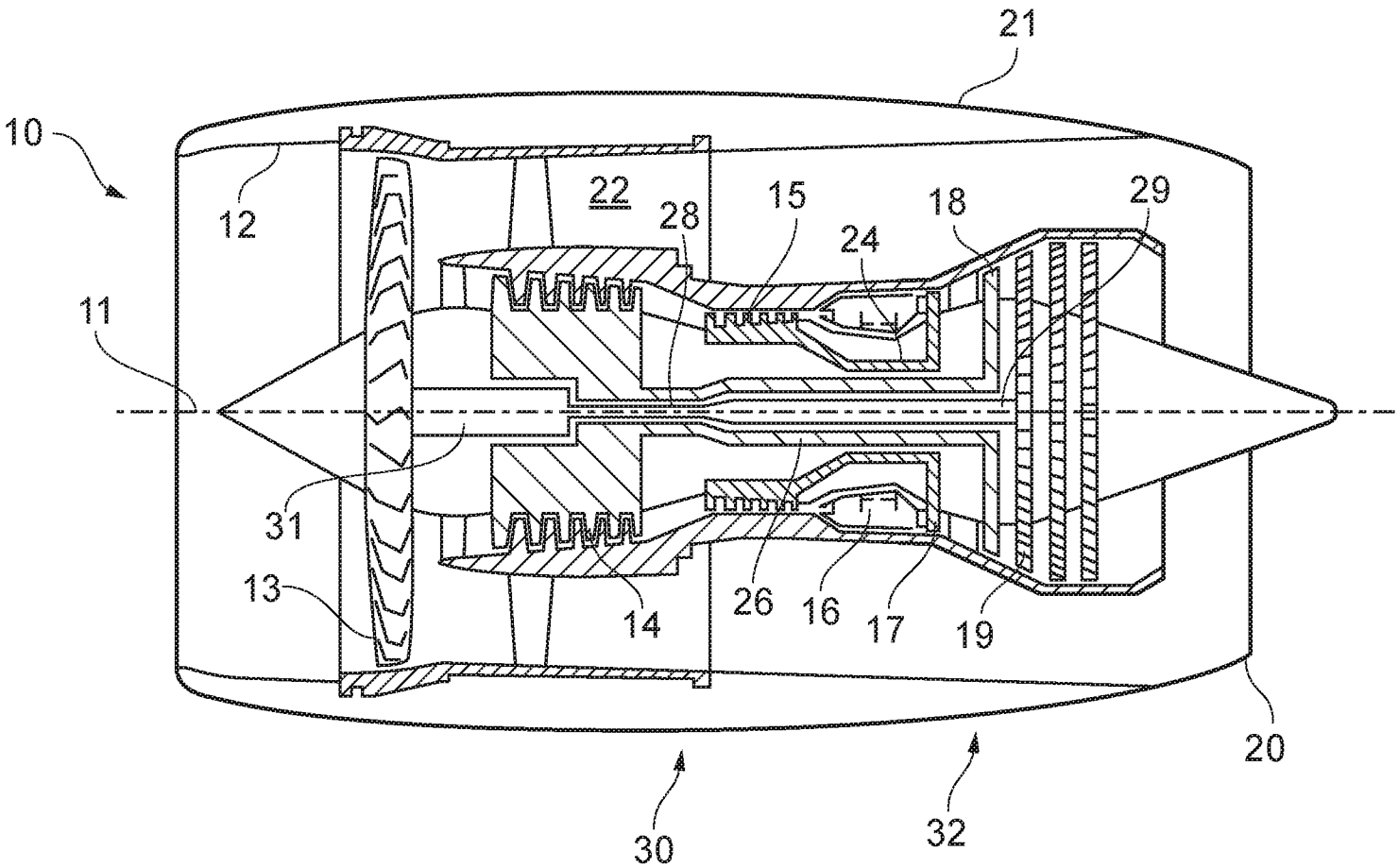
FIG. 1 illustrates a cross sectional side view of a gas turbine engine according to various examples.

FIG. 1 illustrates a gas turbine engine 10 having a principal and rotational axis 11. The engine 10 comprises, in axial flow series, an air intake 12, a propulsive fan 13, an intermediate pressure compressor 14, a high-pressure compressor 15, combustion apparatus 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion apparatus 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high pressure turbine 17 drives the high pressure compressor 15 via a high pressure shaft 24. The intermediate pressure turbine 18 drives the intermediate pressure compressor 15 via an intermediate pressure shaft 26. The low pressure turbine 19 drives the fan 13 via a low pressure shaft 28 (which includes a low pressure turbine shaft 29 and a low pressure compressor shaft 31).

Other gas turbine engines to which the present disclosure may be applied may have alternative configurations. By way of example, such engines may have an alternative number of interconnecting shafts (two for example) and/or an alternative number of compressors and/or turbines. Further the engine may comprise a gearbox provided in the drive train from a turbine to a compressor and/or fan.

The low pressure shaft 28 and/or the intermediate pressure shaft 26 and/or the high pressure shaft 24 comprise a nanocrystalline bainitic steel as described in the following paragraphs.

The nanocrystalline bainitic steel consists of, by weight percentage: 0.3% to 0.6% carbon; 9.0% to 20.0% nickel; up to 10% cobalt; 1.0% to 4.5% aluminium; up to 0.5% molybdenum; up to 0.5% manganese; up to 0.5% tungsten; up to 3.0% chromium; and the balance being iron and impurities. The nickel and the aluminium may form nickel aluminide intermetallic particles in the steel.

In some examples, the nanocrystalline bainitic steel consists of, by weight percentage: 0.35% to 0.45% carbon; 11.0% to 15.0% nickel; 2.0% to 6.0% cobalt; 2.0% to 3.0% aluminium; 0.2% to 0.4% molybdenum; 0.05% to 0.25% manganese; up to 0.5% tungsten; up to 3% chromium; and the balance being iron and impurities.

In one example, the nanocrystalline bainitic steel consists of, by weight percentage: 0.4% carbon; 13.0% nickel; 4.0% cobalt; 2.5% aluminium; 0.3% molybdenum; 0.15% manganese; and the balance being iron and impurities.

Where the low pressure shaft 28 comprises the above mentioned nanocrystalline bainitic steel, the low pressure turbine shaft 29 may not comprise a joint between a first end 30 (coupled to the low pressure compressor shaft 31) and a second opposite end 32 (coupled to the low pressure turbine 19). In other words, the low pressure turbine shaft 29 may substantially only consist of the nanocrystalline bainitic steel.

Figure 2:
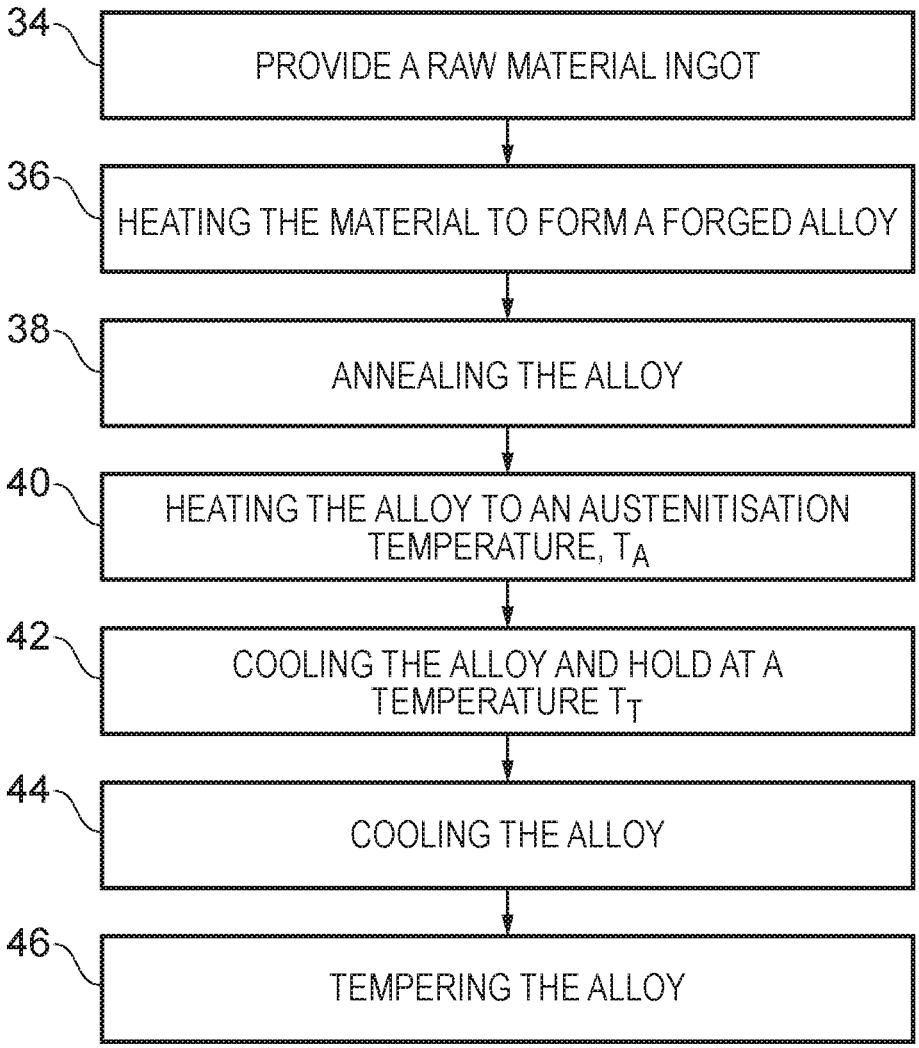
FIG. 2 illustrates a flow diagram of a method of manufacturing nanocrystalline bainitic steel according to various examples.
Figure 3:
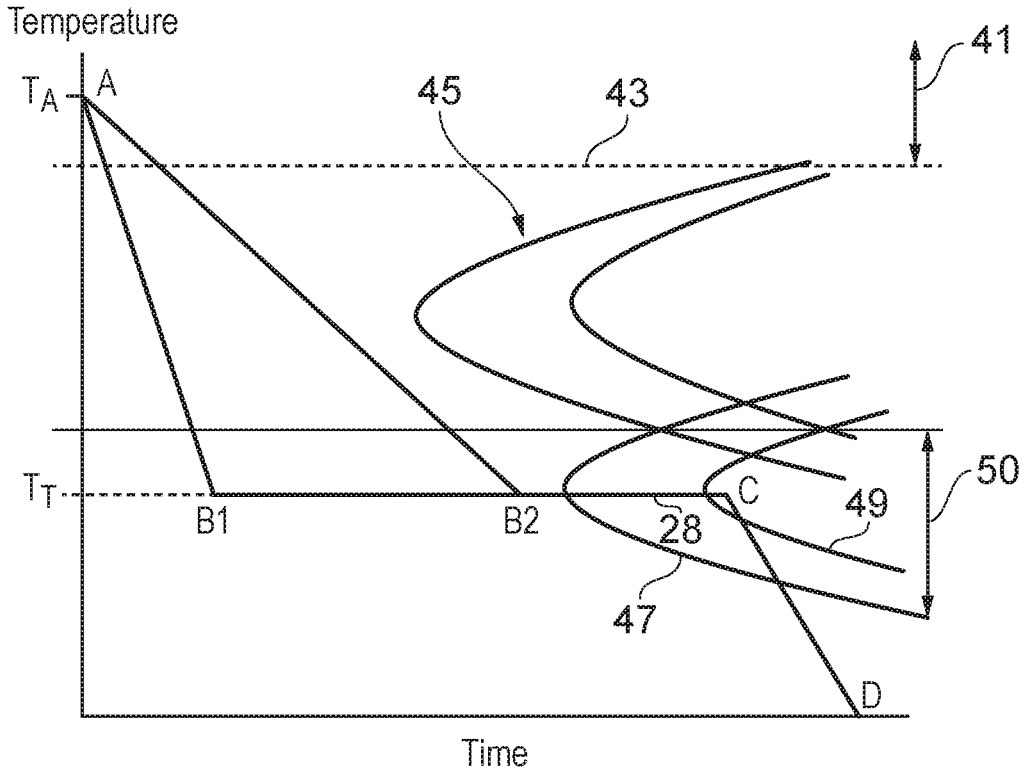
FIG. 3 illustrates a time/temperature/transformation diagram for nanocrystalline bainitic steel according to various examples.

The nanocrystalline bainitic steel may be manufactured in accordance with the following process as described with reference to FIGS. 2 and 3.

At block 34, the method includes providing a raw material ingot for manufacturing the nanocrystalline bainitic steel. At block 34, the raw material ingot may be homogenised. For example, the raw material ingot may be heated to a homogenisation temperature of approximately 1200 Celsius for a homogenisation time period of up to about two days.

At block 36, the method includes heating the material to form a forged alloy. For example, the material may be heated for hot working to a temperature in excess of 1100 Celsius and forged or rolled to a final size with a finishing temperature of above 900 Celsius. The forged alloy is then air cooled to ambient temperature.

At block 38, the method includes annealing the alloy. For example, the alloy may be sub-critically annealed at a temperature of about 750 Celsius for a time in excess of one hour. After annealing, the alloy is air cooled to ambient temperature.

At block 40, the method includes heating the alloy to an austenitisation temperature $T_A$. The range 41 of possible austenitisation temperatures is illustrated in FIG. 3. It is usually desirable to austenitise at as low a temperature as possible (above the austenite start temperature 43) since this will minimise the size of the austenite grains. Bainite nucleates from the austenite grain boundaries and consequently, a smaller austenite grain size enables the bainite to form more quickly. The temperature of the alloy is maintained at the austenitisation temperature for as long as necessary to form a substantially austenitic structure. For example, the alloy may be heated to an austenitisation temperature between 950 Celsius and 1100 Celsius for a time in excess of one minute until the alloy comprises austenite only.

At block 42, the method includes cooling the alloy and then maintaining the temperature of the alloy at a transformation temperature $T_T$ (for example, between 150 Celsius and 350 Celsius). For example, where the alloy has a bar shape, the edges of the bar cool faster than the core (following the solid line in FIG. 3 to time B1) and reach the transformation temperature $T_T$ before the core (which follows the solid line in FIG. 3 to time B2). The temperature of the bar is controlled until the whole bar is at the transformation temperature $T_T$.

The cooling of the alloy is controlled to avoid the pearlite "nose" 45 which includes a left hand line representing the pearlite start line, and a right hand line which represents the pearlite finish line. The area between the pearlite start and finish lines indicates the time/temperature region in which pearlite can form in the alloy.

The alloy is then held at the transformation temperature $T_T$ until the bainite transformation is complete at time C. In more detail, line 47 is the bainite start line and line 49 is the bainite finish line. The area between the bainite start line 47 and the bainite finish line 49 indicates the time/temperature region in which austenite may be transformed into bainite.

The transformation temperature $T_T$ may be any temperature within the range 50. As mentioned above, the transformation temperature $T_T$ may be any temperature within the range 150 Celsius to 350 Celsius.

At block 44, the method includes cooling the alloy to ambient temperature at time D. For example, the alloy may be furnace cooled to ambient temperature.

At block 46, the method includes tempering the alloy subsequent to the bainitic transformation being completed. For example, the alloy may be tempered at a temperature between 250 Celsius and 500 Celsius to form nickel aluminide intermetallic particles in the alloy.

Performing the bainitic transformation (block 42) at relatively low temperatures causes the alloy to have a nanocrystalline structure and provides the alloy with a relatively high strength. For example, the bainite plates may have a width of less than 50 nanometres.

The nanocrystalline bainitic steel may provide several advantages. First, the steel comprises a relatively low amount of carbon (when compared to conventional 'super-bainitic' steels) which reduces the carbide precipitation in the steel.

Second, the steel comprises relatively high amounts of nickel which stabilises the austenite to allow the formation of bainite at relatively low temperatures and produce a nanocrystalline bainitic structure. Furthermore, the relatively high amounts of nickel may improve the fracture toughness of the steel.

Third, the steel may be strengthened by the precipitation of nickel aluminide intermetallic particles during tempering that mitigate the loss of strength associated with carbide precipitation.

Fourth, the composition of the nanocrystalline bainitic steel may enable the steel to retain the ductile phase subsequent to the tempering at block 46.

Fifth, where the nanocrystalline bainitic steel comprises molybdenum and/or manganese, these elements may tie up residual impurities, and in the case of molybdenum, form high temperature secondary carbides that provide significant contributions to strength that persist to high temperatures.

Sixth, where the nanocrystalline bainitic steel comprises chromium and/or tungsten, these elements may contribute to secondary hardening.

Seventh, since the nanocrystalline bainitic steel is capable of carrying relatively high torques at high temperatures, a low pressure turbine shaft may be manufactured solely from the nanocrystalline bainitic steel. This may reduce the cost and complexity of manufacturing the low pressure turbine shaft.

Eighth, the nanocrystalline bainitic steel may have relatively high fatigue strength and may be manufactured using a clean vacuum melt route to reduce the size and quantity of non-metallic inclusions.

It will be understood that the invention is not limited to the embodiments above-described and various modifications and improvements can be made without departing from the concepts described herein. For example, an object (other than a shaft) may comprise the nanocrystalline bainitic steel described in the preceding paragraphs.

Except where mutually exclusive, any of the features may be employed separately or in combination with any other features and the disclosure extends to and includes all combinations and sub-combinations of one or more features described herein.

What is claimed is:

1. A nanocrystalline bainitic steel consisting of, by weight percentage:

0.3% to 0.6% carbon;
9.0% to 20.0% nickel;
up to 10% cobalt;
1.0% to 4.5% aluminium;
up to 0.5% molybdenum;
up to 0.5% manganese;
up to 0.5% tungsten;
up to 3.0% chromium,
a plurality of nickel aluminide intermetallic particles formed from said nickel and aluminium; and
the balance being iron and impurities.

2. A nanocrystalline bainitic steel as claimed in claim 1, wherein the weight percentages are:

0.35% to 0.45% carbon;
11.0% to 15.0% nickel;
2.0% to 6.0% cobalt;
2.0% to 3.0% aluminium;
0.2% to 0.4% molybdenum;
0.05% to 0.25% manganese;
up to 0.5% tungsten;
up to 3% chromium; and
the balance being iron and impurities.

3. A nanocrystalline bainitic steel as claimed in claim 1, wherein the weight percentages are:

0.4% carbon;
13.0% nickel;
4.0% cobalt;
2.5% aluminium;
0.3% molybdenum;
0.15% manganese; and
the balance being iron and impurities.

4. A shaft comprising the nanocrystalline bainitic steel as claimed in claim 1.

5. A shaft as claimed in claim 4, wherein the shaft is a low pressure shaft and includes a low pressure compressor shaft and a low pressure turbine shaft, the low pressure turbine shaft having a first end, a second opposite end, and a longitudinal axis extending between the first end and the second end, the low pressure turbine shaft having no joint between the first end and the second end.

6. A method of manufacturing a nanocrystalline bainitic steel as claimed in claim 1, comprising maintaining a transformation temperature of the steel between 150 Celsius and 350 Celsius, and further comprising tempering the steel to form a plurality of nickel aluminide intermetallic particles.

7. A method as claimed in claim 6, wherein tempering the steel is performed at a temperature between 250 Celsius and 500 Celsius.

* * * * *